United States Patent [19]

Merenda

[11] Patent Number: 4,622,039

[45] Date of Patent: Nov. 11, 1986

[54] METHOD AND APPARATUS FOR THE RECOVERY AND REUSE OF SOLVENTS IN DRY CLEANING SYSTEMS

[76] Inventor: Rosario Merenda, 22 Edgemere Dr., Albertson, N.Y. 11507

[21] Appl. No.: 712,269

[22] Filed: Mar. 15, 1985

[51] Int. Cl.[4] ..... B08B 7/04

[52] U.S. Cl. ..... 8/142; 134/12

[58] Field of Search ..... 8/142; 134/12; 203/49; 202/170

[56] References Cited

U.S. PATENT DOCUMENTS 2,123,434 7/1938 Paulson et al. ..... 134/12

4,243,526 1/1981 Ransmark ..... 203/49

*Primary Examiner*—A. Lionel Clingman

*Assistant Examiner*—John F. McNally

*Attorney, Agent, or Firm*—Bauer & Amer

[57] ABSTRACT

According to the present invention, a dry cleaning washer and a dryer are arranged in a closed cycle system so that the effluent solvent vapor from the washer is delivered to an accumulator chamber generally simultaneously with the delivery from the dryer of effluent hot air. The hot air super heats the solvent vapor increasing its volitization and the heated and highly volatile solvent vapors are then passed to a condenser which includes the feed coils for supplying clean air to the dryer. In passing through the condenser, the super heated solvent vapor, instantly liquifies giving off its heat to the cool air, thus preheating the clean air prior to its entry into the dryer. The liquified solvent is returned to the washer, or to a storage reservoir.

5 Claims, 4 Drawing Figures

METHOD AND APPARATUS FOR THE RECOVERY AND REUSE OF SOLVENTS IN DRY CLEANING SYSTEMS

BACKGROUND OF THE INVENTION

The present invention relates to a method and apparatus for recovering and reusing the solvent in a dry cleaning system.

In conventional dry cleaning systems, the effulent vapors or fumes of the solvent such as perchlorethylene (PERC) emanating from the dry cleaning washing machine and dryers generally are vented directly to the atmosphere and thus pollute the atmosphere. By being so vented, they are also lost for reuse. Thus, the escaping vapors not only produce an environmental hazard, but their loss are extremely costly to the dry cleaning establishment.

Attempt has been made to remove the solvent vapor contained in the air-stream from a dry cleaning machine by passing the solvent laden air-stream through a bed of activated carbon. The carbon adsorbs the solvent vapor or gas held in the air-stream, allowing the thus cleaned air to pass through the carbon bed to atmosphere. See Fuhring et al U.S. Pat. Nos. 3,203,110 and 3,538,615. Unfortunately, the carbon bed will only adsorb approximately one gallon of solvent per 80 lb of carbon before becoming saturated with solvent vapor, and must then be de-adsorbed by passing a "blanket" of steam through the carbon bed in a reverse direction to that of adsorption. The steam and solvent vapors form an azeotrope which must then be condensed, and the resultant water and liquid solvent must be separated according to their specific gravities. Thereafter, the solvent may then be recycled for reuse.

In the foregoing case, expensive and complex equipment is required to provide the carbon, the "steam" cleaning or the cooling condensers, as well as the extensive control equipment necessary for their function. In conventional commercial dry cleaning establishments, the cost for such equipment and for the skilled personnel necessary to operate the equipment is prohibitive.

It is the object of the present invention to economically, simply and with a minimum of equipment and the elimination of attendant personnel, to recapture the cleaning solvent and to reuse the same so that as a result thereof, the solvent is not vented to the atmosphere and thus pollution of the atmosphere is avoided.

It is a further object of the present invention to combine the normally separate dry cleaning washer, and dry cleaning dryer into a closed circulatory system, wherein the heat and cooling necessary to vaporize and condense the solvent are produced in situ without the need for external auxiliary equipment.

It is yet another object of the present invention to provide a closed system for the recovery and reuse of the solvent so that virtually no solvent is vented or lost to atmosphere thereby reducing the threat of any pollution, and the maximization of solvent use.

These objects as well as others will be apparent from the following disclosure.

SUMMARY OF THE INVENTION

According to the present invention, a dry cleaning washer and a dryer are arranged in a closed cycle system so that the effluent solvent vapor from the washer is delivered to an accumulator chamber generally simultaneously with the delivery from the dryer of effluent hot air. The hot air super heats the solvent vapor increasing its vaporization or volitization. The heated and highly volatile solvent vapors are then passed to a condenser which includes the feed coils for supplying clean air to the dryer. In passing through the condenser, the super heated solvent vapor, instantly liquifies giving off its heat to the cool air, thus preheating the clean air prior to its entry into the dryer. The liquified solvent is returned to the washer, or to a storage reservoir.

Preferably the accumulator is a hollow cylinder divided into an upper and a lower chamber. The inlets for the solvent vapor and hot air being in the lower chamber, which is also enlarged to provide a reservoir for any vapor which prematurely liquifies and sufficient space to effect contact between the solvent vapor and the hot air. The upper chamber is provided with a blower which insures flow of vapor and air to the maximum degree for smooth continuous operation.

If desired, the lower chamber may be filled with carbon for adsorbtion of the solvent. However, in this case, the scrubbing of carbon with steam is unnecessary since adsorbed solvent will eventually occur since the solvent is easily vaporized by the hot air from the dryer.

Full details of the present invention are set forth in the following disclosure and are illustrated in the accompanying drawing.

DESCRIPTION OF THE INVENTION

Figure 1:
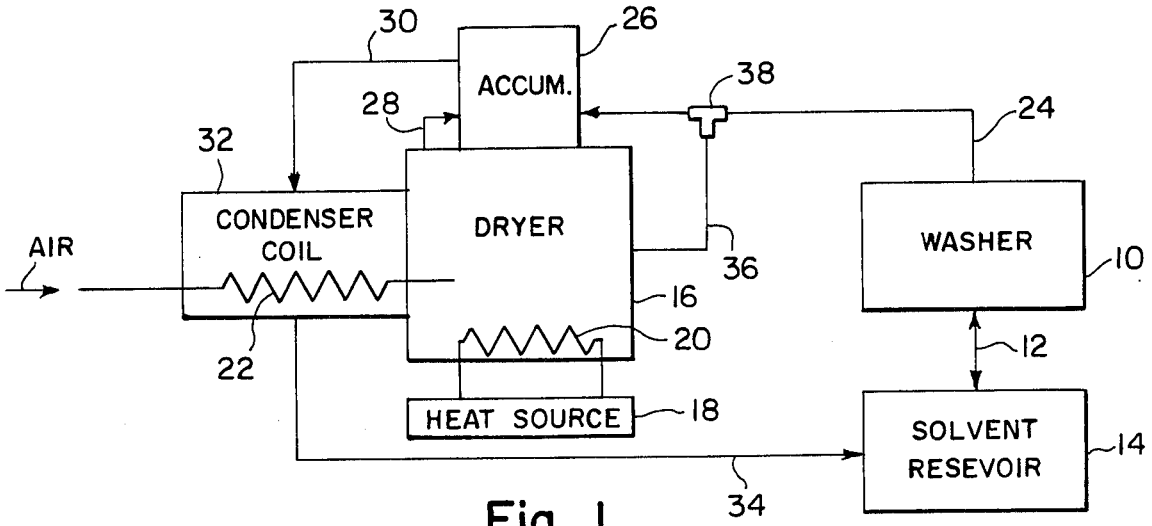
FIG. 1 is a diagram of the recovery and reuse system of the present invention.

FIG. 1 illustrates schematically the combination of a washer and dryer providing for the simple recovery and reuse of the solvent.

A conventional dry cleaning washer 10 of the tumble or drum type is provided with duct or passage means 12 for cyclically supplying and returning a liquid cleaning solvent such as perchlorethylene (PERC), in the usual and conventional manner, from a reservoir such as a tank 14. Similarly a dryer 16 of the tumble or drum type is provided with a source of heat 18 as, for example, steam or vapor heated water passing through a coil 20 located within the dryer. The dryer is also provided with an inlet, in the form of a condenser coil 22, through which clean cool fresh air may be introduced into the dryer.

During the washing cycle, the solvent, interacting with the clothes or textiles in the washer, and subjected to agitation, emits an effluent of solvent vapor. The solvent vapor effluent passes through a duct or passage 24 into an accumulator 26. Simultaneously, the dryer 16 produces a hot air effluent as a result of the heat and air needed to effect drying of the clothes or textiles. The hot air effluent passes from the dryer 16 through a duct or passage 28 into the accumulator 26, where it comes into contact with solvent vapor. The hot air super heats the solvent vapor increasing its volatility which there-upon passes through a duct 30 into a housing 32 in which the condensor coil 22 passes.

As the heated solvent vapor contacts the cooler coil 22, the vapor liquifies and passes through a duct pipe or passage 34 directly into the solvent reservoir 14 for reuse. Simultaneously the heat from the heated solvent vapor passes into the air, that is moving through the coil 22, thus pre-heating the air fed to the dryer 16 before it even enters the dryer. To insure the proper recovery of any solvent vapor from the dryer, a bypass duct 36 leading from the dryer connects via a T-fitting 38 with the duct 24 leading from the washer, thus mixing the solvent vapor from dryer 16 and washer 14 prior to entry in the accumulator.

As will be explained later, the accumulator 26 preferably comprises a hollow chamber, since it is unnecessary to adsorb the solvent vapor or convert the vapor into droplet or quasi-liquid form at that stage. The accumulator, however, is preferably provided with an enlarged volume at its lower end beneath the inlets from the ducts 24 and 28, so that in the event of a temporary shut-down in operation, or saturation of the solvent vapor, the solvent may liquify and be retained therein. Once, however, effluent hot air from the dryer 16 enters into the accumulator, it will heat and begin to convert the volatile solvent into heat vapor driving the vapor from the accumulator and reducing the solvent which may have liquified therein.

In conventional cleaning and drying installations, the heat emanating from the is at least 180 degrees Fahrenheit. This is sufficient to convert any liquified solvent in the accumulator to vapor driving the liquified solvent from the accumulator.

Since the fresh air fed to the dryer through the coils 22 is preferably at ambient room temperature, a sufficient "delta", or temperature difference between the coil and the super heated solvent vapor exists so that almost instantaneous condensation liquification occurs in housing 32. By regulating the flow of solvent vapor into the housing 32, and fresh air through the coils 22 a sufficiently high flow rate of both media can be effected providing for continuous liquification as well as preheating of the air. Although not shown in the drawings, suitable flow regulating valves, pressure guages and regulators can be employed in conventional manner.

The process of the present invention may be modified if desired to avoid the simple condensation of the solvent vapor in the accumulator where it will lay there overnight or for substantial periods of time. The solvent may be adsorbed in a carbonaceous material such as a charcoal or carbon filter material placed in the accumulator. By adsorbing it in the carbon, the solvent is no longer retained in a liquid form but retained within the solid carbon material and adsorbed to the surfaces thereof.

Normally, the solvent cannot be released from the adsorbing surfaces of the carbon until the carbon becomes fully saturated and then only through the use of steam or super heated water. However, in the present system the solvent is quickly released from the carbon adsorbing surfaces by subjecting such surfaces to the great heat of the dryer exhaust (180 degrees Fahrenheit) which is more than sufficient to drive the solvent off the carbon surfaces as vapor. Thus, the carbon material if and when used functions only as a temporary holder for the solvent when the solvent must remain in the accumulator chamber for such periods as overnight or over a weekend.

In the present invention, no extraneous or external heat is required to treat the solvent in the accumulator to cause the same to vaporize into fumes upon the start up of the day's work. In the morning although the solvent remains accumulated in the chamber, all that is necessary is to start the dryer to the point where its heat is sufficient to cause the solvent to be released from either the bottom of the pool of solvent material lying in the accumulator or from the carbon material that may be contained in the accumulator.

One of the novel features of the invention is that it utilizes the heat of the conventional and in situ system for generating the solvent vaporization or fumes even after the system has been shut down for some period of time and the solvent has has an opportunity to condense and liquify at the bottom of the chamber.

Another of the novel features of the invention resides in the method of treating the solvent laden vapor fumes that emanate from the washer. Unlike the conventional systems which are normally vented to the atmosphere, such fumes are redirected back into the system by way of an accumulator and condenser.

Thus, the method consists of operating a conventional dry cleaning installation in a closed environment proof system in which solvent laden fumes emanating from the dry cleaning machine are heated by the heat of the dryer, and such heater fumes are directed to a condenser at which the fumes are then condensed and liquified and returned to the washing machine tank for reuse. This saves the cost of wasted cleaning fluid and maintains the integrity of the atmosphere.

Another advantage of the present invention lies in providing the dryer with two coils. One is hot, the other is generally considered to be cooler. The solvent laden in the clothes is turned to fumes and blown in the dryer over or through the heated coils of the dryer where they too are super heated and they are thus directed to the accumulator for mixture with the solvent laden vapor fumes from the washer. The cooler fresh air is introduced into the dryer as a scavenging media to cleanse the clothes and dryer of residual solvent vapor, and due to its preheating, reduces the heat source requirements for the dryer.

Figure 2:
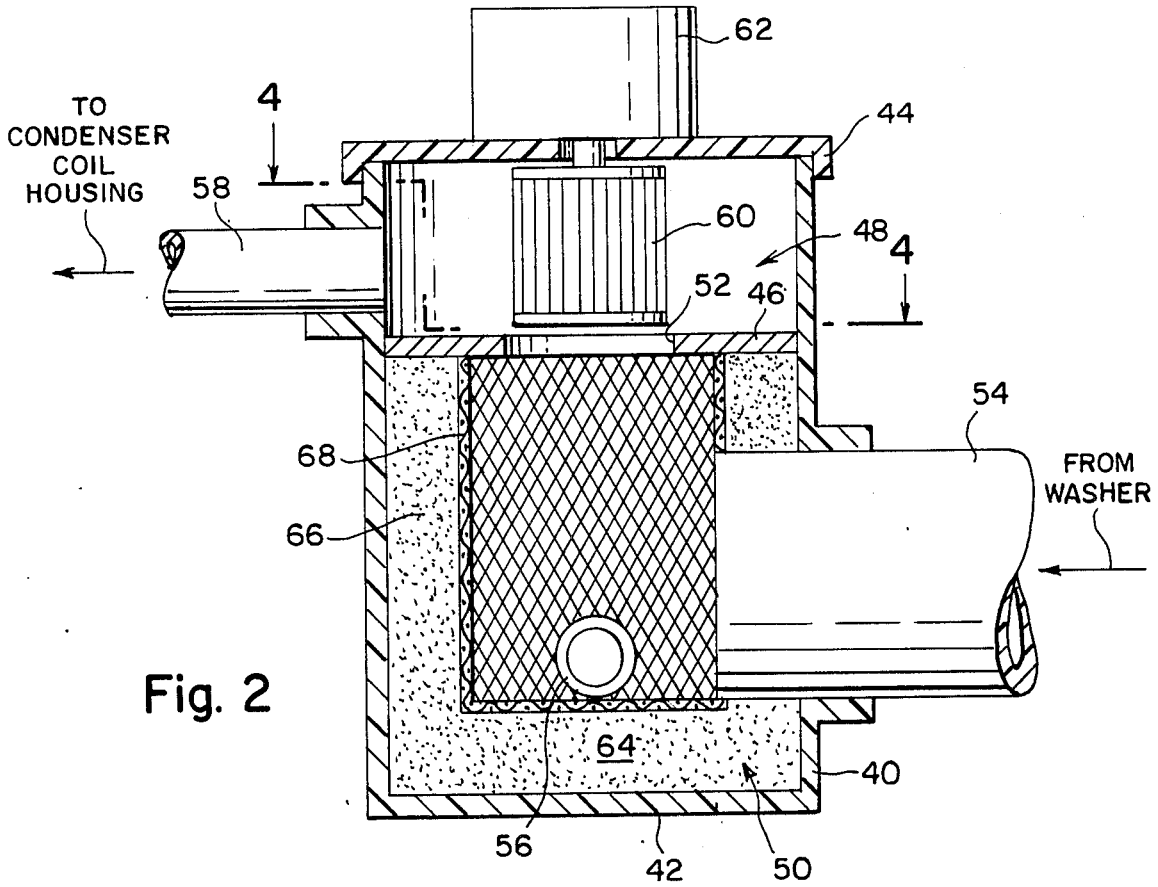
FIG. 2 is a vertical section of the accumulator used in the system of FIG. 1.
Figure 3:
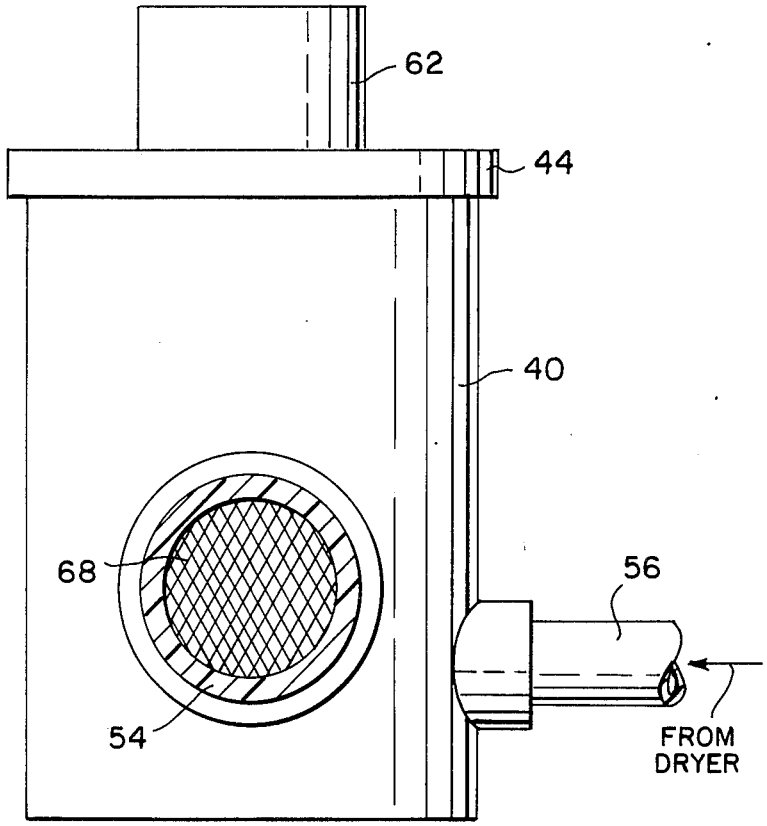
FIG. 3 is an elevational view of the accumulator rotated about the vertical axis counter clockwise 90 degrees from the view of FIG. 2.
Figure 4:
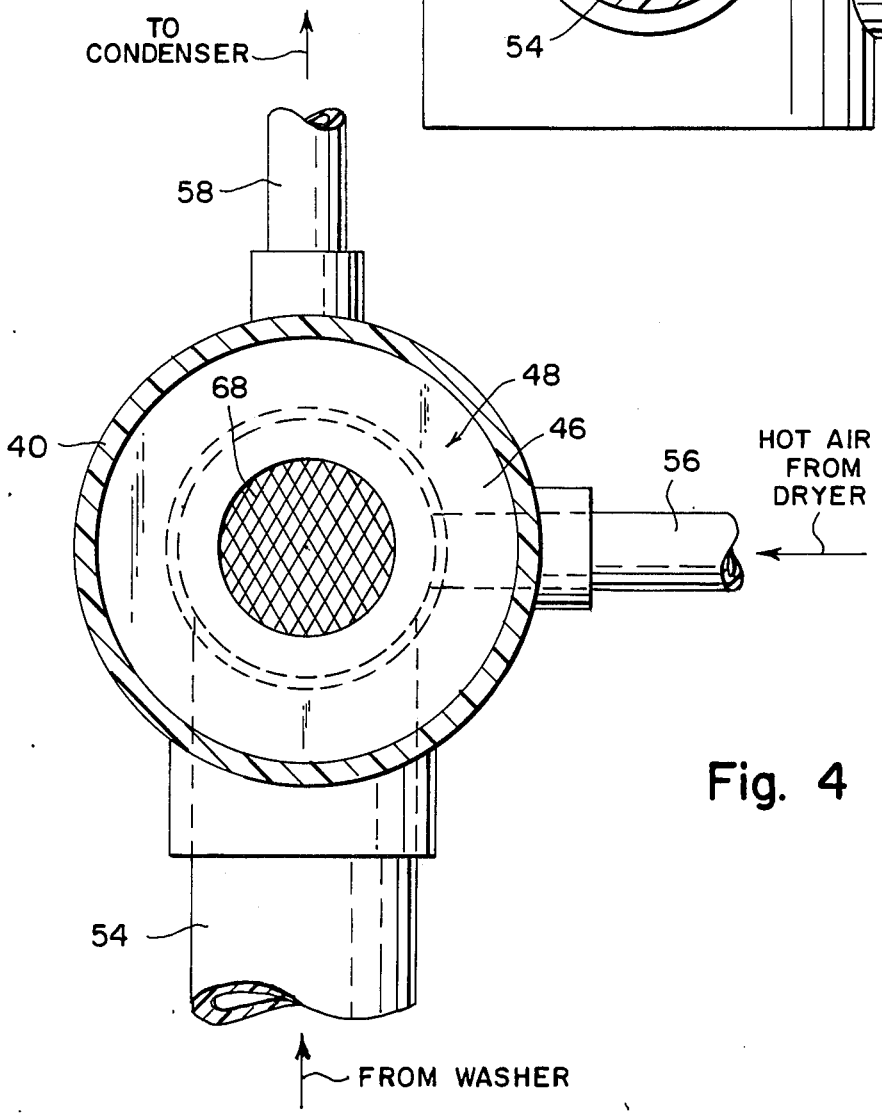
FIG. 4 is a sectional view of the accumulator taken along line 4—4 of FIG. 2, and rotated about the vertical axis clockwise 90 degrees.

Illustrated in FIGS. 2–4 is a specific, although not necessarily immutable form of an accumulator capable of functioning in the foregoing system. As seen, the accumulator comprises a generally cylindrical container 40 having a closed bottom 42 and a removable cover cap 44. The hollow interior of the container 40 is provided with a wall 46 extending perpendicularly to the central axis of the container. The wall 46 is sealed or forced fit in contact with the interior wall of the container to divide the container into an upper chamber 48 and a lower chamber 50 distinct from each other. A central hole 52, or series of holes if desired, is formed in the wall 46 establishing communication between the two chambers 48 and 50. Preferably the lower chamber 50 is substantially larger than the upper chamber 48 to provide ample room for retention of a large volume of solvent vapor and hot air.

Entering radially into the lower chamber 50 is a large inlet 54 adapted for connection to the solvent vapor outlet of the washer unit. Offset, at about 90 degrees from the solvent vapor inlet, and of substantially smaller size is a second inlet 56 adapted for connection to the hot air exhaust of the dryer. Exiting from the upper chamber 48 and diametrically opposite from the solvent vapor inlet 54 is an outlet 58 adapted for connection to the housing 32 containing the cool condenser coil 22 (FIG. 1).

The solvent vapor from the washer 10 flows into the lower chamber 50, where it makes contact with the hot air exhaust from the dryer 16. The heated solvent vapor passes through the hole 52 in the wall 46, into the upper chamber 48 and thence through outlet 58 to the condenser. To exhance and control the flow rate through the accumulator, a blower 60 is located in the upper chamber 48, and is driven by a motor 62 mounted on the removable cover cap 44.

The blower aids in the flow of the solvent vapor from their respective machines and pressurizes the flow to the condenser to aid in the rapid movement of solvent vapor from their respective machines to the condenser housing 32. The blower in the accumulator apparatus performs the function of sucking and applying a negative pressure to both the dryer and the washer to positively withdraw the solvent laden vapor fumes into the accumulator and to then blow such fumes to the condenser for liquification.

The inlets 54 and 56 from the washer and dryer respectively are arranged an extent above the bottom wall 44 of the container so as to provide sufficient space to form a reservoir 64 in the bottom of the container for retention of liquid which may result from normal condensation in the accumulator as when the system is shut down or closed overnight.

To facilitate operation and act as a control for the solvent vapor, the lower chamber 50 may be at least partially filled with a bed 66 of activated charcoal adapted to adsorb the solvent. As explained earlier this is not essential but does have certain advantages when used. To contain the charcoal, a filter cup 68 made of open wire mesh is installed concentrically with the opening 52. The bottom of the filter cup 68 is spaced above the bottom 42 of the container to maintain the reservoir space 64.

Should a bed of charcoal or other sorbent material be used, then it is advisable to continue the solvent vapor inlet 54 and the hot air inlet 56 radially into the container toward its center so that they disgorge within the filter cup 68. In this way, the vapor flow and hot air flow will not disturb the charcoal particles in the bed, yet have sufficient contact for vapor volatilization. Only excess vapor and hot air would move outwardly of the filter and penetrate the carbon to be adsorbed thereby and/or stripped therefrom as previously described.

The operation of the described accumulator is fully understandable from the prior description of the system illustrated and described in connection with FIG. 1 without further elaboration here. The form of the accumulator may vary as, for example, the container need not be cylindrical. If carbon is employed, a filter cup may be dispersed with and replaced with a simple filter screen across the hole 52. The blower may be replaced with a vacuum pump or the like.

It is evident that those skilled in the art may now make numerous uses and modifications of the specific embodiments described herein without departing from the inventive concepts disclosed. Consequently, the invention is to be construed as embracing each and every novel feature and novel combination of features present in or possessed by the apparatus and techniques herein disclosed and limited solely by the spirit and scope of the appended claims.

It is claimed:

1. A method comprising recovering and recycling a dry cleaning solvent in a system having a dry cleaner washer unit employing a low-boiling point solvent and a hot air dryer unit comprising the steps of directing the effluent solvent vapor from said washer unit to an accumulator wherein said solvent vapor is held, directing the effluent hot air from said dryer unit to said accumulator to pass in direct contact with the solvent vapor held within said accumulator to heat at least a portion of said vapors, directing said heated vapor portion to a condenser through which an external ambient air stream is fed to said dryer, said condenser simultaneously condensing said heater solvent vapor portion into a liquid and preheating said ambient air fed to said dryer, and recycling said condensed solvent to said washer unit for reuse.

2. The method according to claim 1, wherein said solvent vapor is passed between said washer unit, accumulator and condenser in a closed system free of dispersal into the ambient atmosphere.

3. The method according to claim 2, including the step of passing the condensed solvent liquid to a storage tank prior to its reuse in said washer.

4. The method according to claim 1, including the step of passing solvent vapor from said drying unit to said accumulator for mixture with said solvent vapor from said washer unit.

5. The method according to claim 1, including the step of filtering said solvent vapor in said accumulator through a carbon bed.

* * * * *